US010566708B2

(12) United States Patent
Garton et al.

(10) Patent No.: US 10,566,708 B2
(45) Date of Patent: Feb. 18, 2020

(54) ELECTRICAL CONNECTOR

(71) Applicant: QUICKWIRE LIMITED, Twyford Reading (GB)

(72) Inventors: Stephen D. Garton, Oxfordshire (GB); Rita Man, Essex (GB)

(73) Assignee: QUICKWIRE LIMITED, Twyford Reading (GB)

( * ) Notice: Subject to any disclaimer, the term of this patent is extended or adjusted under 35 U.S.C. 154(b) by 0 days.

(21) Appl. No.: 15/996,114

(22) Filed: Jun. 1, 2018

(65) Prior Publication Data

US 2018/0287272 A1 Oct. 4, 2018

Related U.S. Application Data

(63) Continuation of application No. PCT/GB2016/005362, filed on Nov. 22, 2016.

(30) Foreign Application Priority Data

Dec. 1, 2015 (GB) ..... 1521174.1

(51) Int. Cl.
*H01R 4/24* (2018.01)
*H01R 4/48* (2006.01)
(Continued)

(52) U.S. Cl.
CPC ..... *H01R 4/489* (2013.01); *H01R 4/4818* (2013.01); *H01R 13/631* (2013.01); *H01R 13/112* (2013.01); *H01R 13/28* (2013.01)

(58) Field of Classification Search
CPC .. H01R 4/2429; H01R 4/2433; H01R 23/025; H01R 31/02
(Continued)

(56) References Cited

U.S. PATENT DOCUMENTS 2,534,881 A * 12/1950 Schroeder ..... H01R 4/2412 174/84 S
3,760,331 A * 9/1973 Gurley ..... H01R 4/2466 439/391
(Continued)

FOREIGN PATENT DOCUMENTS

DE 102 30 367 A1 1/2004
DE 10 2006 010 309 A1 9/2007
(Continued)

*Primary Examiner* — Thanh Tam T Le
(74) *Attorney, Agent, or Firm* — Levine Bagade Han LLP

(57) ABSTRACT

The present invention provides an electrical connector, comprising a shuttle member for receiving a stripped multi-core cable (such as a twin and earth conductor cable), the shuttle member including a core guide means and a resilient clip member for each of the stripped cores to be received. A body portion is configured to support at least one shuttle member in sliding engagement and includes an array of terminal connections, each connection having a shaped contact to receive a respective clip member of the shuttle member. Each shaped contact defines a jaw member operable to compress a respective clip member when the shuttle member is fully engaged with the body portion to thereby grip the stripped cores of the multi-core cable. The electrical connector has particular application as an electrical junction box for lighting circuits.

20 Claims, 12 Drawing Sheets

(51) Int. Cl.
*H01R 13/631* (2006.01)
*H01R 13/28* (2006.01)
*H01R 13/11* (2006.01)

(58) Field of Classification Search
USPC ..... 439/395, 417, 418, 724
See application file for complete search history.

(56) References Cited

U.S. PATENT DOCUMENTS 4,597,622 A 7/1986 Coe
4,932,877 A * 6/1990 Zinn ..... H01R 13/18 439/839
5,035,661 A * 7/1991 Steinhardt ..... H01R 13/4223 439/595
5,044,979 A * 9/1991 Siemon ..... H01R 4/2429 439/404
5,961,342 A * 10/1999 Daoud ..... H01R 4/2429 439/403
6,027,361 A * 2/2000 Burmeister ..... H01R 4/2425 439/395
6,361,352 B2 * 3/2002 Barrat ..... H01R 4/2466 439/395
6,722,926 B2 * 4/2004 Chevassus-More ..... H01R 13/113 439/721
7,223,115 B2 * 5/2007 Hashim ..... H01R 4/245 439/403
7,867,013 B2 * 1/2011 Cox ..... H01R 4/2433 439/404
8,062,056 B2 * 11/2011 Lee ..... H01R 4/2433 439/395
8,262,404 B2 * 9/2012 Neumetzler ..... H01R 4/2429 439/404
8,366,497 B2 * 2/2013 Glick ..... H01R 9/245 439/839
8,512,066 B2 * 8/2013 Lee ..... H01R 4/2433 439/395
9,190,756 B2 * 11/2015 Glick ..... H01R 13/18

FOREIGN PATENT DOCUMENTS

EP 1 742 299 A2 1/2007
GB 844444 A 8/1960
WO WO 2017/093711 6/2017

* cited by examiner (a)
(b)
(c)
(d)
(e)
100
102
102a
104
106
108
108a
110
C
D
SECTION C-C
SECTION B-B
ISOMETRIC VIEW

ELECTRICAL CONNECTOR

CROSS-REFERENCE TO RELATED APPLICATIONS

This application is a continuation of International Application No. PCT/GB2016/053627, filed Nov. 22, 2016, which claims priority to United Kingdom Patent Application No. 1521174.1, filed Dec. 1, 2015, both of which are incorporated by reference in their entireties.

BACKGROUND

The present invention relates to electrical connectors and electrical junction boxes, and in particular to an improved electrical connector for lighting circuits etc.

Electrical junction boxes are commonly used in both domestic and commercial environments. Junction boxes typically provide a secure and relatively maintenance-free method of connecting fixed wiring in indoor applications, whether that be under a floor, in a ceiling void, in an attic or in any place where cables need to be joined together, for example, to extend and/or re-wire an existing circuit etc.

A common type of junction box consists of an array of four separate screw terminals, all housed within an insulated body having a removable lid to facilitate access for wiring up the box. Usually, each of the four terminals will have two or more cable cores connected to it, so that different wiring configurations of the incoming cables can be achieved. One example of a use of a junction box is to connect a supply to a switch and a light source (such as domestic lighting), so that the switch can operate the light. In many cases, an additional power cable may also be wired into the junction box to enable onward supply to another lighting circuit or spur, so that further lights may be controlled.

A further use of a junction box may alternatively be to simply serve as a means for connecting up a number of cables to a common connector.

Although conventional junction boxes are useful, they do suffer from several notable disadvantages. For example, junction boxes typically require a considerable length of time in order to be safely wired up. Moreover, given the arrangement of terminals and cores, specialist electrical knowledge is normally needed to ensure that the wiring is done correctly and that the preparation of the cable (e.g. the stripped length of the cores etc.) is carried out properly to enable the cables to reach each of the required terminals without stressing the core and while avoiding any possibility of short circuits. Even when the cable cores have been suitably prepared, it may still be quite difficult for an electrician to simultaneously position and retain up to four cable cores under a particular terminal screw until such time that he is able to tighten the screw. Such a task can be further exacerbated if access to the junction box is limited or otherwise inconvenient due to its location. Additional difficulties may ensue where a twin and earth cable is being used, in that it is then necessary to separately sleeve or sheath the earth conductor to insulate the core from the other cores, while also identifying the core as an earth conductor.

Wiring regulations in some countries now consider junction boxes with screw terminals to require maintenance, and consequently only permit their use where there is reasonable access for servicing. Since junction boxes, particularly in domestic settings, are often located within ceiling voids or between flooring etc., access may be problematic or indeed impossible, for example, if the ceiling is plastered or the overlying floor has a fixed carpet or wooden laminate flooring etc. In such situations, it may be possible to install special inspection plates, but this is rarely desirable given the expense and aesthetically displeasing end result.

It may be possible in some arrangements to gain access to a junction box via a hole or aperture in the ceiling where a recessed light fitting (e.g. a spotlight) is installed. However, more often than not, common junction boxes (as those described above) are invariably too large and cumbersome to be removed through the hole of a typical recessed light fitting, since not only may the box itself be bulky but it will normally have multiple cables radiating from the box. It is expected that as new lighting technology develops, the holes for recessed light fittings are likely to become smaller and smaller, and consequently access to junction boxes via this method will prove to be even more difficult with time.

Finally, some countries have also further updated their wiring regulations to require that cables which are not continuously supported, must have their outer sheaths secured where they are terminated. Therefore, in the case of a common junction box (which does not have cable or sheath grips), it is necessary to support the cables by, for example, fixing them with cable clamps to the fabric of the building (e.g. a roof joist etc.) to avoid the unsupported cables from exerting undue force on the individually terminated conductors. In such scenarios, it is therefore impossible to access and remove the junction box, irrespective of its size, from the hole of a recessed light fitting etc.

In response to the problems posed by common junction boxes, the prior art has offered some limited solutions, which have typically involved streamlining the shape of the junction box and including cable or sheath grips. However, in each example it remains the case that a significant amount of wiring up of the cables is required, usually with specialist knowledge, which is both fiddly and time consuming. While cable or sheath grips just add an additional time penalty to the time required for wiring the junction box. Moreover, in most of the solutions provided by the art, the hole or aperture required for access is still reasonably large, which is problematic given the trend for ever smaller and smaller light fittings.

It is therefore an object of the present invention to mitigate or overcome the above drawbacks and problems in the art and to provide a quick, safe and maintenance-free electrical connector for connecting multiple cables together, while addressing the issue of accessibility.

SUMMARY

According to an aspect of the present invention there is provided an electrical connector, comprising:

a shuttle member for receiving a stripped multi-core cable, the shuttle member including a core guide means and a resilient clip member for each of the stripped cores to be received; and a body portion configured to support at least one shuttle member in sliding engagement and including an array of terminal connections, each connection having a shaped contact to receive a respective clip member of the shuttle member;

wherein each shaped contact defines a jaw member operable to compress a respective clip member when the shuttle member is fully engaged with the body portion to thereby grip the stripped cores of the multi-core cable.

The provision of an electrical connector comprising a shuttle member including a resilient clip member for each of the stripped cable cores, and a body portion including an array of terminal connections, each connection having a shaped contact defining a jaw member operable to compress a respective clip member when the shuttle member is fully engaged is found to be particularly advantageous, as the cable can be connected to the electrical connector very quickly via a simple push-fit action without the need for any screw terminals or any specialist electrical knowledge.

Indeed, any individual who is able to strip the ends of a multi-core cable or wire, using any conventional wire stripper, can easily and swiftly use the electrical connector of the present invention without any training or prior electrical experience.

Moreover, the absence of screw terminals in the present electrical connector reduces the time required to connect the cables, while also avoids the restriction in some countries that the electrical connector must be readily accessible for inspection and maintenance—thereby, mitigating the need for special inspection plates or access hatches in floors or ceilings etc.

Further advantages of the electrical connector will become evident in the following description of the exemplary embodiments of the present invention.

It is to be appreciated that any suitable multi-core cable may be used in conjunction with the present invention. By 'multi-core' we mean any cable that includes more than one electrical conductor (e.g. wire) running along the cable's length, and in particular is intended to encompass all 3-core mains electrical cables, such as twin and earth cable. Therefore, references to 'core' herein are intended to include single electrical conductors and wires.

Moreover, references herein to 'stripped core' are intended to encompass cores that have had at least a portion of their outer electrical insulation or sheath removed to expose the electrical conductor within. Therefore, in exemplary embodiments, a 'stripped core' will comprise at least a length of an insulated or sheathed core, with at least a portion of exposed electrical conductor (or wire) at one end.

In exemplary embodiments, the electrical connector of the present invention is ideally in the form of an electrical junction box, and is particularly suited for connecting together components of domestic and commercial lighting systems.

The shuttle member which is supported and retained by the body portion is configured to receive a stripped multi-core cable. The shuttle member is preferably substantially rectangular in shape and comprises a first end to receive the cable and an opposing end which is retained within the body portion via a sliding engagement.

The first end preferably comprises an open channel of circular cross-section which is intended to receive and guide the cable towards the core guide means. The open channel is preferably dimensioned so as be only slightly larger in width than the width dimension of the cable to be received. In exemplary embodiments, the electrical connector is intended to be used with a 3-core cable having a flattened profile, whereby all of the cable cores are aligned on the same plane adjacent to one another. The use of a flattened cable greatly facilitates the action of the core guide means, as will be described below.

At the opposing end of the shuttle member, which is retained within the body member, there is preferably disposed a plurality of open slots, with one slot for each of the number of stripped cores to be received. The slots extend parallel to the longitudinal axis of the shuttle member, and in exemplary embodiments, there are three slots disposed adjacent to each other. The resilient clip members are integral to the shuttle member and are arranged such that there is one resilient clip member disposed in each of the slots of the shuttle member.

In preferred embodiments, the resilient clip member takes the form of a conductive metal contact having a substantially flattened 'C'-shaped profile. The 'C'-shaped profile of the resilient clip member defines a compressible jaw, which when compressed together is operable to engage with and grip a stripped core of the cable to be received. A resilient clip member is disposed in each respective slot such that the open part of the jaw faces inwards towards the centre of the shuttle member. Therefore, the closed arcuate shaped part of the resilient clip member (which effectively acts as a 'hinge' for the jaw) faces outwards and is accessible through each respective open slot.

The core guide means is also preferably disposed internally to the shuttle member and is located at the bottom end of the open channel which receives the cable. In preferred embodiments, the core guide means comprises a baffled channel for each of the stripped cores to be received, which in exemplary embodiments means three baffled channels—one each for a Live, Earth and Neutral core of the cable. The function of each baffled channel is to guide the stripped cores towards each of the respective clip members, which are so arranged such that their open jaws face towards a respective baffled channel. In preferred embodiments, the core guide means comprises a 'V' or delta shaped funnel arrangement with three openings leading to a respective baffled channel. As the cable is inserted into the opening of the shuttle member, the adjacently arranged stripped cores then encounter the three openings, which due to the baffle arrangement of the channels, results in each of the stripped cores being guided into a respective one of the channels. The baffle arrangements preferably comprising tapering sections that guide the respective stripped cores. As such, the stripped cores of the cable are splayed apart as the cable is inserted into the shuttle member, leading to a separation of the exposed conductors of the stripped cores of at least 3 mm—which is the regulated minimum separation for 240 Vac in the UK.

Each opening and baffled channel is configured and dimensioned so as to receive only a single stripped core. Therefore, there is no possibility of more than one stripped core being able to enter into the same channel of the core guide means. Such a feature therefore advantageously facilitates easy insertion of the cable into the shuttle member, as the installer need only offer up the stripped cable to the opening of the shuttle member and insert the cable, while the core guide means automatically guides the stripped cores to their respective channels and splays the stripped cores apart in accordance with the regulated separation.

Of course, it is to be appreciated that some care needs to be taken with the orientation of the cable relative to the shuttle member, since if the cable is 'upside down', for example, the cores will be reversed relative to the channels and the Live and Neutral connections could be inadvertently swapped over. However, to assist the installer with the orientation of the cable, the open end of the shuttle member can be marked with the polarity of the connection, so that a 'L' for live or a 'N' for neutral can be indicated so that the installer knows which way round the cable needs to be before inserting the cable into the shuttle member. It should be understood, however, that any other suitable marking or indication of polarity may be used instead of 'L' and 'N', dependent on the particular implementation and/or country of use etc.

Once the cable has been inserted into the shuttle member, the exposed conductors of the stripped cores then reside in each of a respective open jaw of a resilient clip member. However, at this stage, since the clip members are not under compression (since the shuttle member has not advanced fully into the body portion), the exposed conductors of the stripped cores are not yet gripped by the clip members.

In exemplary embodiments, the shuttle member further comprises an automatic cable gripping means for gripping the outer surface of the cable. The cable gripping means may preferably take the form of a pair of pivotable or hinged arm members attached to the body of the shuttle member with a respective 'hook' at each end. Each arm may be disposed on an opposite side of the shuttle member, such that the hook can automatically engage with the outer sheath or coating of the unstripped portion of the cable when the shuttle member is pushed into the body portion so that it is fully engaged. The arms are then pressed against the cable, thereby firmly gripping the outer surface of the cable. The cable can then only be removed with considerable force.

The automatic nature of the cable gripping means saves additional time in connecting the cable, while the presence of the gripping means also satisfies the regulations in those countries that require the cables to be supported. In this way, no cable clamps or other fixings are required to support the cables, which again increases accessibility to the electrical connector, since it is not required to be fixed to a roof or floor joist etc.

The shuttle member also preferably comprises a pair of protrudences or elongate arms integral to the body of the shuttle member and which serve as latches for latching the shuttle member to the body portion, enabling the body portion to retain the shuttle member, and also for gripping the shuttle member during manipulation, e.g. when inserting the cable etc. The protrudences preferably extend along the longitudinal axis of the shuttle member and may be texturised to facilitate grip of the shuttle member as it is slidingly advanced into the body portion to thereby fully engage the shuttle member with the body portion.

The body portion is preferably substantially elongate in form and is dimensioned so as to be essentially 'long and thin', with a maximum width dimension preferably not much larger than the width dimension of the shuttle member itself. A major advantage of an elongate body portion is that at least some embodiments of the present electrical connector are able to pass through a standard 58 mm hole of a conventional recessed light fitting, and indeed can pass through holes as small as 32 mm in diameter, for example. In this way, the electrical connector of the present invention mitigates against issues of accessibility of electrical junction boxes, as it is possible to easily access and remove the electrical connector through the typical hole sizes used for conventional lighting. Moreover, as will be discussed below, the cables connected to the present electrical connector extend generally along the longitudinal axis of the body portion or else are substantially aligned in this direction, and so unlike conventional junction boxes that may have a myriad of cables extending radially from the box, there are no issues of cables preventing the removal and/or inspection of the present electrical connector in ceiling voids or in under floor areas. Of course, no limitations on the size of the present electrical connector are implied by any of the above example dimensions.

In exemplary embodiments, the body portion is configured to support and retain at least two shuttle members in respective sliding engagement, and may include up to four shuttle members depending on the particular implementation and/or application. However, it is to be appreciated that the electrical connector of the present invention is inherently scalable and therefore the body portion could be extended to support additional shuttle members as required, although it is to be understood that to maintain a low-profile for the electrical connector the number of shuttle members is optimally set at a maximum of four.

The body portion is operable to lock the shuttle member into the body portion when the shuttle member is slidingly advanced into the body portion so as to be fully engaged. The shuttle member is always retained by the body portion and in exemplary embodiments is not a separate component or 'plug in' part. Instead, the shuttle member is constrained to move backwards and forwards relative to the body portion, until such time the cable is inserted and the shuttle member is advanced further into the body portion so that the shuttle member moves into a 'locked position', which corresponds to 'full engagement' between the shuttle member and the body portion. At no stage can the shuttle member be removed from the body portion.

When fully engaged, the protrudences on the shuttle member latch against reciprocal detents in the interior of the body portion, resulting in a non-reversible connection between the shuttle member and the body portion. By 'non-reversible' herein we mean that the shuttle member cannot be withdrawn from its locked position without excessive force, resulting in damage to either the shuttle member or body portion, or both the shuttle member and body portion. The only technique to remove the shuttle member is via a special, bespoke, extraction tool, which preferably is only available to electricians and specialist installers. An advantage of this feature is that it avoids the risk of casual or accidental release of the cable and exposing live conductors. Therefore, to all intents and purposes, once the shuttle member is fully engaged with the body portion, the shuttle member cannot therefore be practically removed.

The 'non-reversibility' of the connection in the present invention, advantageously results in a safe, reliable and maintenance-free connection between the shuttle member and the body portion.

A significant function of the body portion, in addition to retaining and latching the shuttle member, is to provide a support means for the array of terminal connections. The array is preferably disposed within the inner central volume of the body portion and preferably comprises a spaced arrangement of conductive contacts. In preferred embodiments, the spaced arrangement has a substantially 'H'-shaped configuration, with each end portion at the top and bottom of the vertical arms of the 'H' having a shaped contact defining a jaw member. Preferably, the jaw member has a substantially arcuate or flattened 'C'-shaped profile, which is configured and dimensioned to receive a respective resilient clip member of the shuttle member.

In exemplary embodiments, each H-shaped conductive contact corresponds to a respective one of a Live, Neutral or Earth terminal. In the case of a 3-core mains cable, the terminal connections are arranged such that there are three H-shaped contacts disposed adjacently and spaced apart from each other by an insulated support.

Of course, it is to be appreciated that the particular arrangement of the terminal connections will depend on the desired implementation and circuit layout in which the electrical connector is to be used. Therefore, the H-shaped contacts may be configured such that a discontinuity or insulated break is formed in one or more of the H-shaped contacts, which may then be arranged so that some of the contacts are conductively connected to another contact, allowing the electrical connector to be used as a switch and light junction unit. Alternatively, the contacts may remain isolated from each other so that the electrical connector may be used as a spur/light junction unit as required. Moreover, in some applications, the shaped contacts may take on a different form to that of a H-shaped profile, and so other shaped arrangements may be used depending on the wiring and/or particular electrical connections.

In exemplary embodiments, the terminal connections are arranged within the body portion such that when the shuttle member is advanced into and fully engaged with the body portion, the resilient clip members of the shuttle member engage with a respective one of the jaw members of the shaped contacts. As the resilient clip members are forced into the jaw members of the shaped contacts, the clip members are then compressed and deflected by the jaw members, causing the open jaws of the clip members to close around a respective exposed conductor at the end of a stripped core of the cable. When the shuttle member is fully engaged, the resilient clip members then reside within the jaw members of the shaped contacts and a firm grip of the exposed conductors of the stripped cores is then achieved by each respective clip member. The cable is consequently secured and a safe and reliable electrical connection is then made between the exposed conductors, the clip member and the shaped contact of the body portion—without any risk that the exposed conductor can become lose or otherwise pop out of the shaped contact.

To facilitate engagement with the exposed conductors of the stripped cores of the cable, each resilient clip member may include a recessed notch at the edge of each jaw member to receive and grip the exposed conductors as the clip member is compressed. The recessed notch is preferably semi-circular in form.

The leading edges of the jaw members of the shaped contacts may also comprise a lipped portion to narrow the opening of the jaw member to thereby enhance compression of the resilient clip member.

Both the shuttle member and the body portion are preferably fabricated from an insulated plastic.

To facilitate operation of the electrical connector and to assist generally with manipulating the body portion, the outer surface of the body portion may be texturised to aid grip.

Although in the exemplary embodiments, as described above, the shuttle members are always retained within the body portion in sliding engagement and are not intended to be removed. Other embodiments could alternatively involve having a separate shuttle member as a 'plug-in' component, whereby the cable would initially be inserted into the shuttle member itself which would then effectively act as 'cable plug'. In such embodiments, the body portion would then receive the cable plug, such that when the plug was advanced and fully engaged with the body portion, the resilient clip members would be compressed and deflected by the jaw members, causing the open jaws of the clip members to close around a respective exposed conductor of a stripped core of the cable. Therefore, the functionality of the connector in these embodiments would be similar to the functionality as described in the exemplary embodiments.

The present invention also provides for an electrical circuit comprising a power source and at least one electrical connector according to any of the preceding embodiments. The electrical circuit preferably comprises at least one light source connected to both the power source and at least one of the electrical connectors.

It is to be appreciated that none of the embodiments or examples described in relation to the present invention are mutually exclusive, and therefore the features and functionality of one embodiment or example may be used interchangeably or additionally with the features and functionality of any other embodiment or example without limitation.

BRIEF DESCRIPTION OF THE DRAWINGS

Embodiments of the present invention will now be described in detail by way of example and with reference to the accompanying drawings in which.

DETAILED DESCRIPTION

Figure 1:
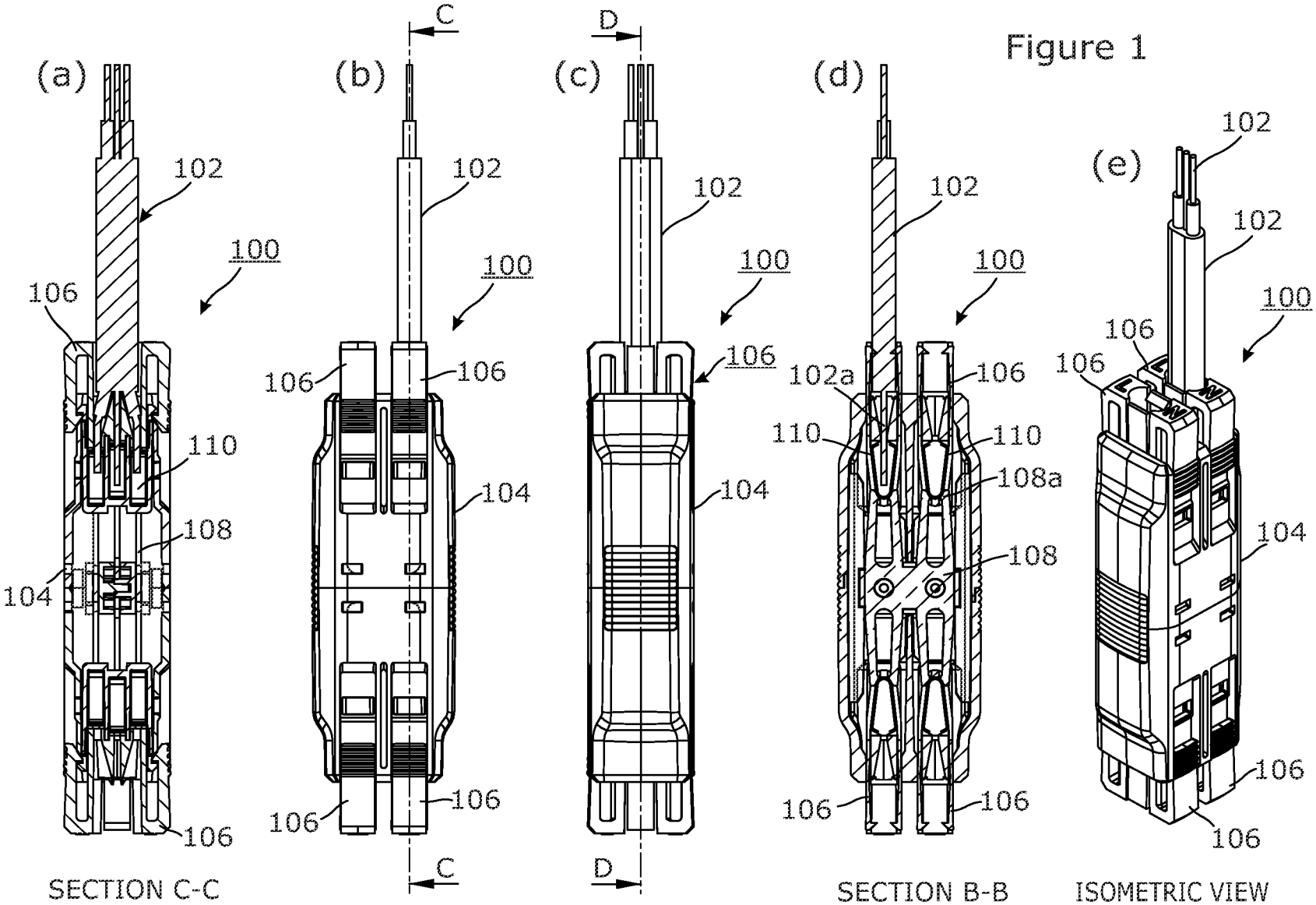
FIGS. 1(*a*)-1(*e*)—show an exemplary embodiment of an electrical connector according to the present invention with the shuttle member not fully engaged—1(*a*) cross-section along line C-C of side view of 1(*b*); 1(*c*) top plan view and 1(*d*) cross-section along line B-B; and 1(*e*) side perspective view.
Figure 9:
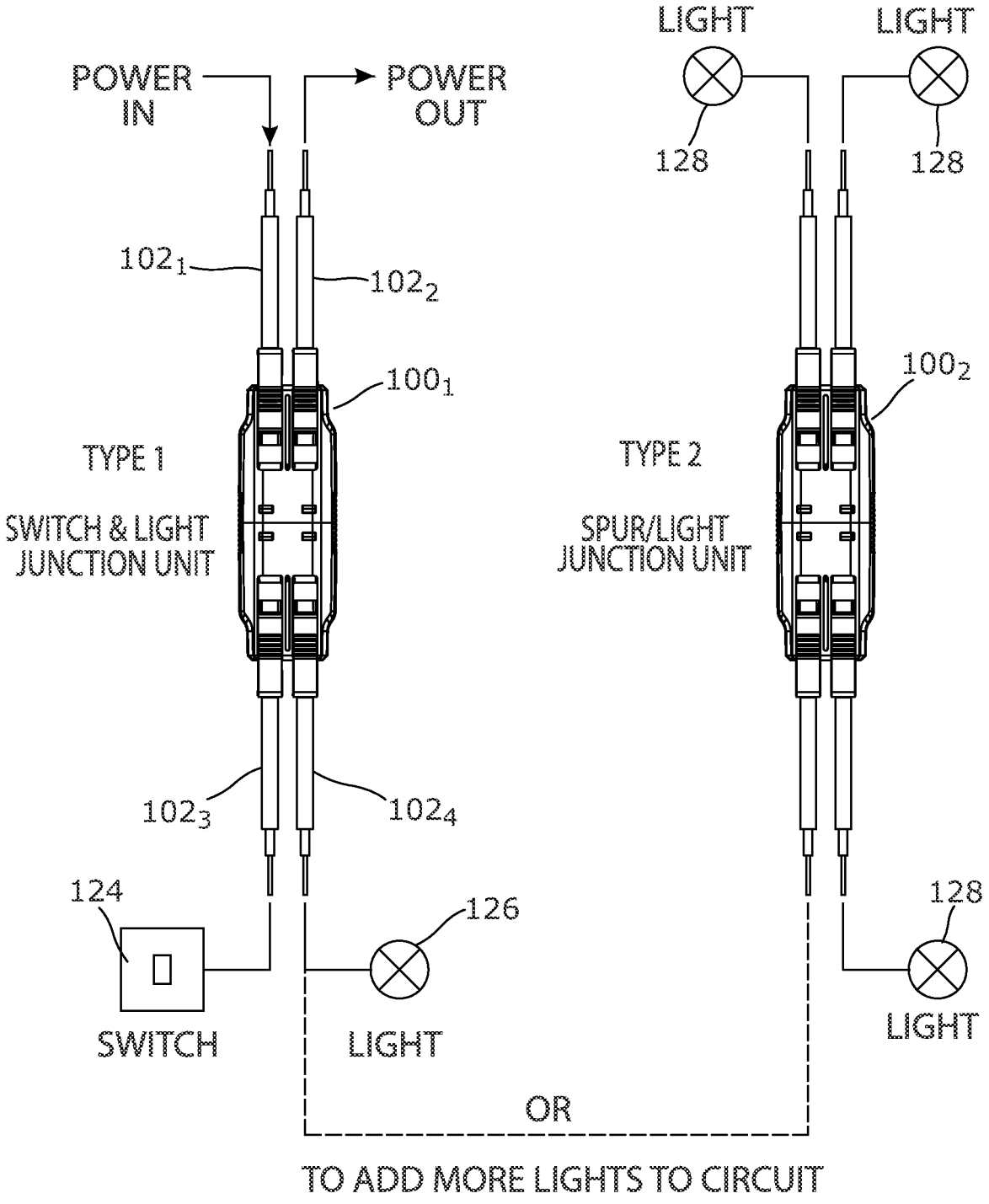
FIG. 9—shows a schematic view of an example circuit according to the present invention.
Figure 10A:
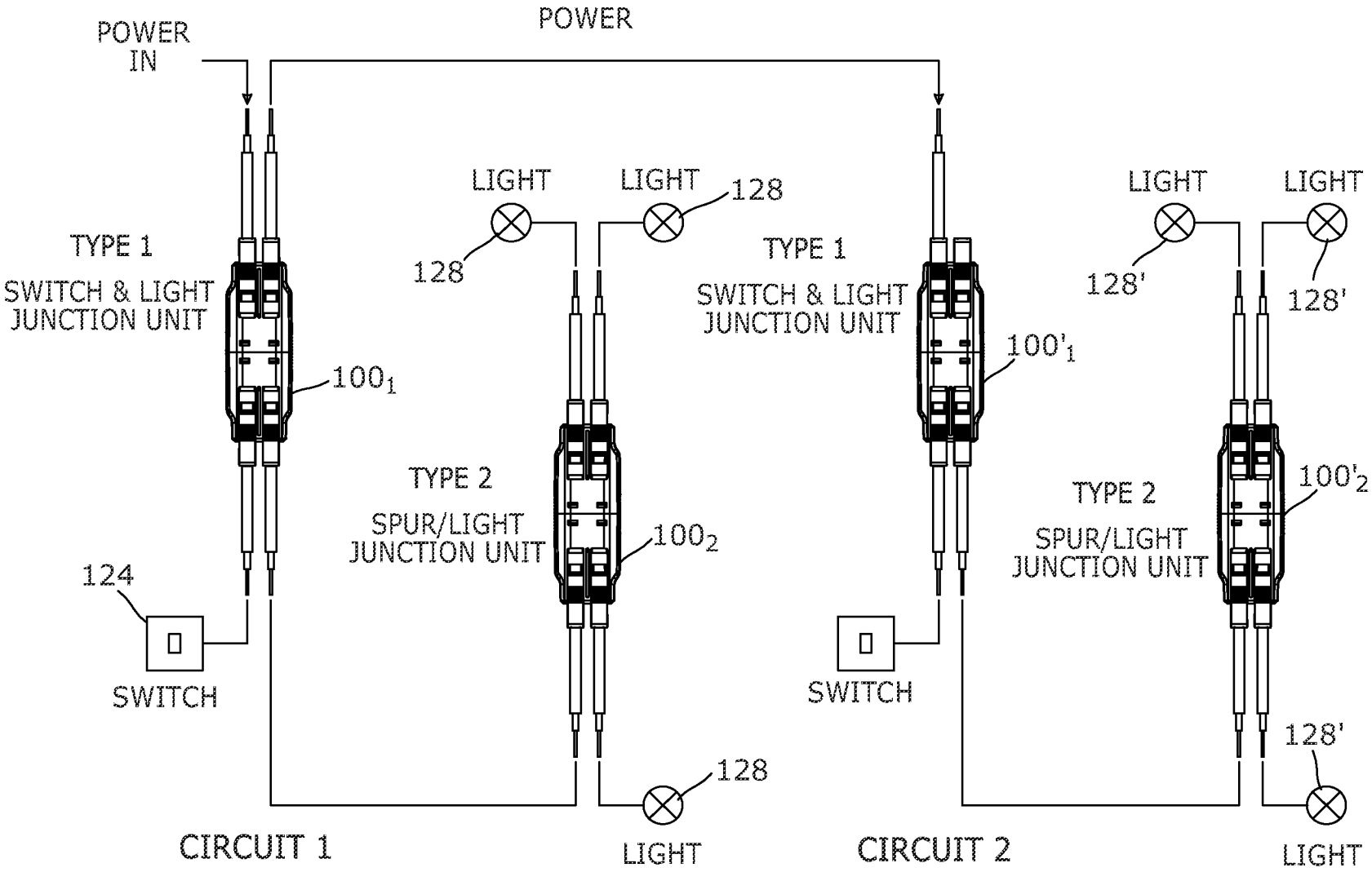
FIGS. 10A & 10B—show schematic views of further example circuits according to the present invention.
Figure 10B:
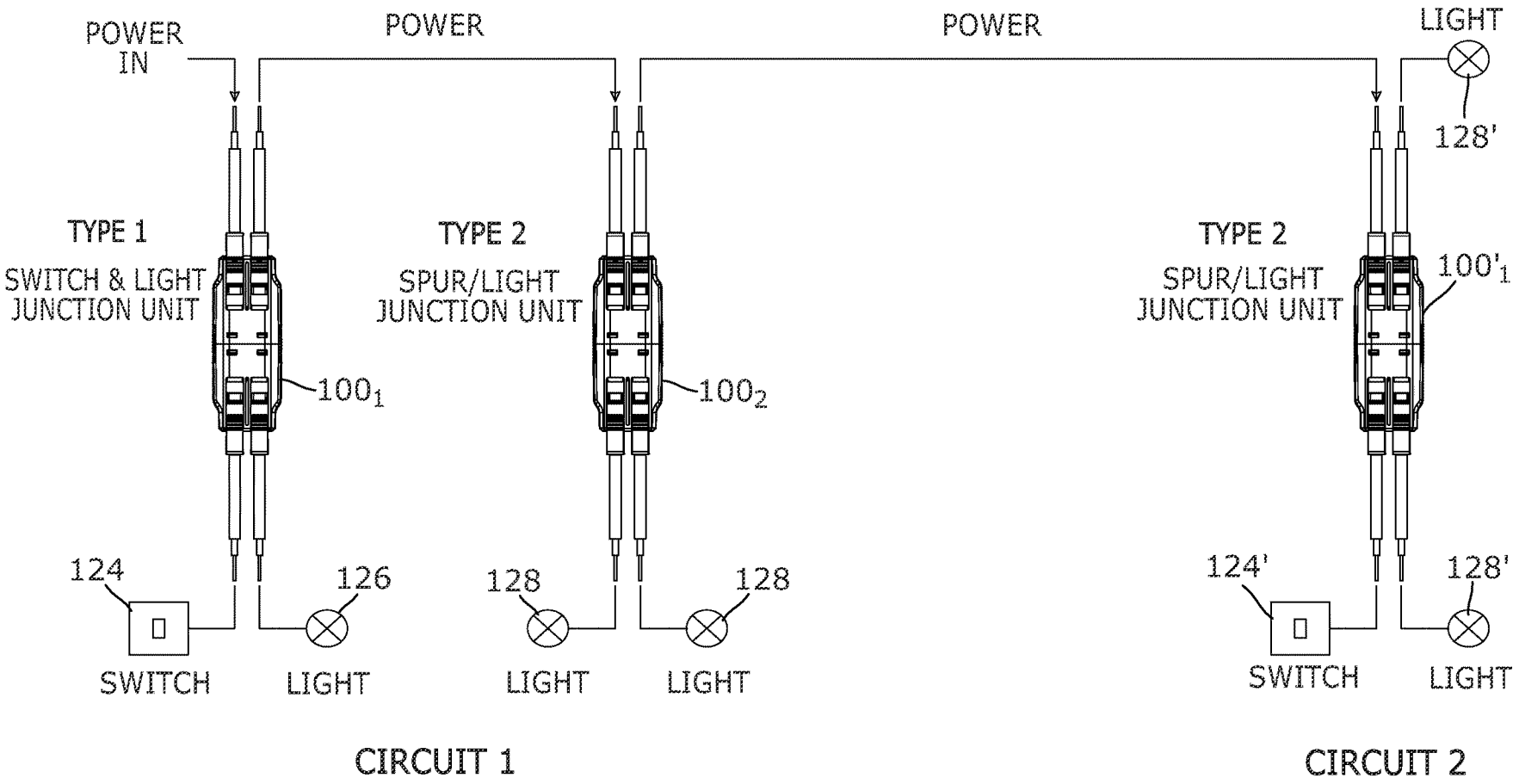

Referring to FIGS. 1(*a*)-(*e*), there is a shown a particularly preferred embodiment of an electrical connector 100 according to the present invention. In exemplary embodiments the electrical connector 100 is in the form of an electrical junction box for an electrical lighting circuit (as shown in FIGS. 9, 10A & 10B), and in the example of FIGS. 1(*a*)-(*e*) is being used with a twin and earth (3-core) electrical cable 102. The cable 102 is a flat-type cable in which the 3-cores 102*a* are arranged adjacent to each other as best shown in FIG. 1(*e*).

The electrical connector 100 comprises a body portion 104 configured to support and retain at least one shuttle member 106 in sliding engagement (i.e. for movement back and forth). In the example of FIGS. 1(*a*)-(*e*), the body portion 104 is shown with four shuttle members 106, which are not yet fully advanced into or engaged with the body portion 104. For reasons of clarity, only one cable 102 is shown in FIGS. 1(*a*)-(*e*), however it is to be appreciated that in practice each shuttle member 106 would have a corresponding cable 102.

As shown in FIGS. 1(*a*)-(*e*), the body portion 104 is substantially elongate in form and is dimensioned so as to be essentially 'long and thin', with a maximum width dimension not much larger than the width dimension of the shuttle member 106 itself. A major advantage of an elongate body portion 104 is that the present electrical connector is able to pass through, for example, a standard 58 mm hole of a conventional recessed light fitting, and indeed can pass through holes as small as 32 mm in diameter.

Figure 7:
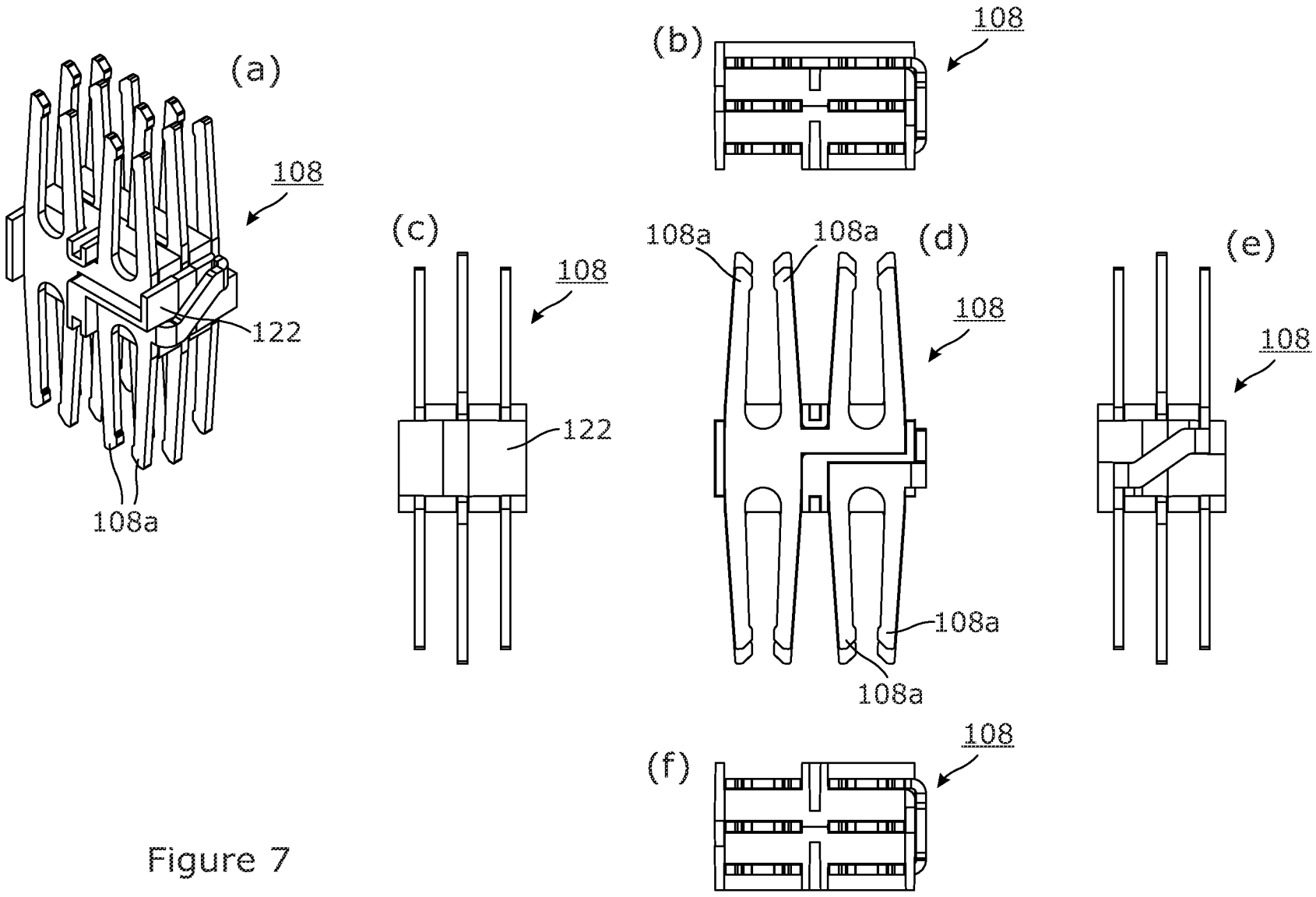
FIGS. 7(*a*)-7(*f*)—show an exemplary embodiment of an array of terminal connections—7(*a*) side perspective view; 7(*b*) top plan view; 7(*c*) side view; 7(*d*) front view; 7(*e*) opposing side view; and 7(*f*) bottom view.
Figure 8:
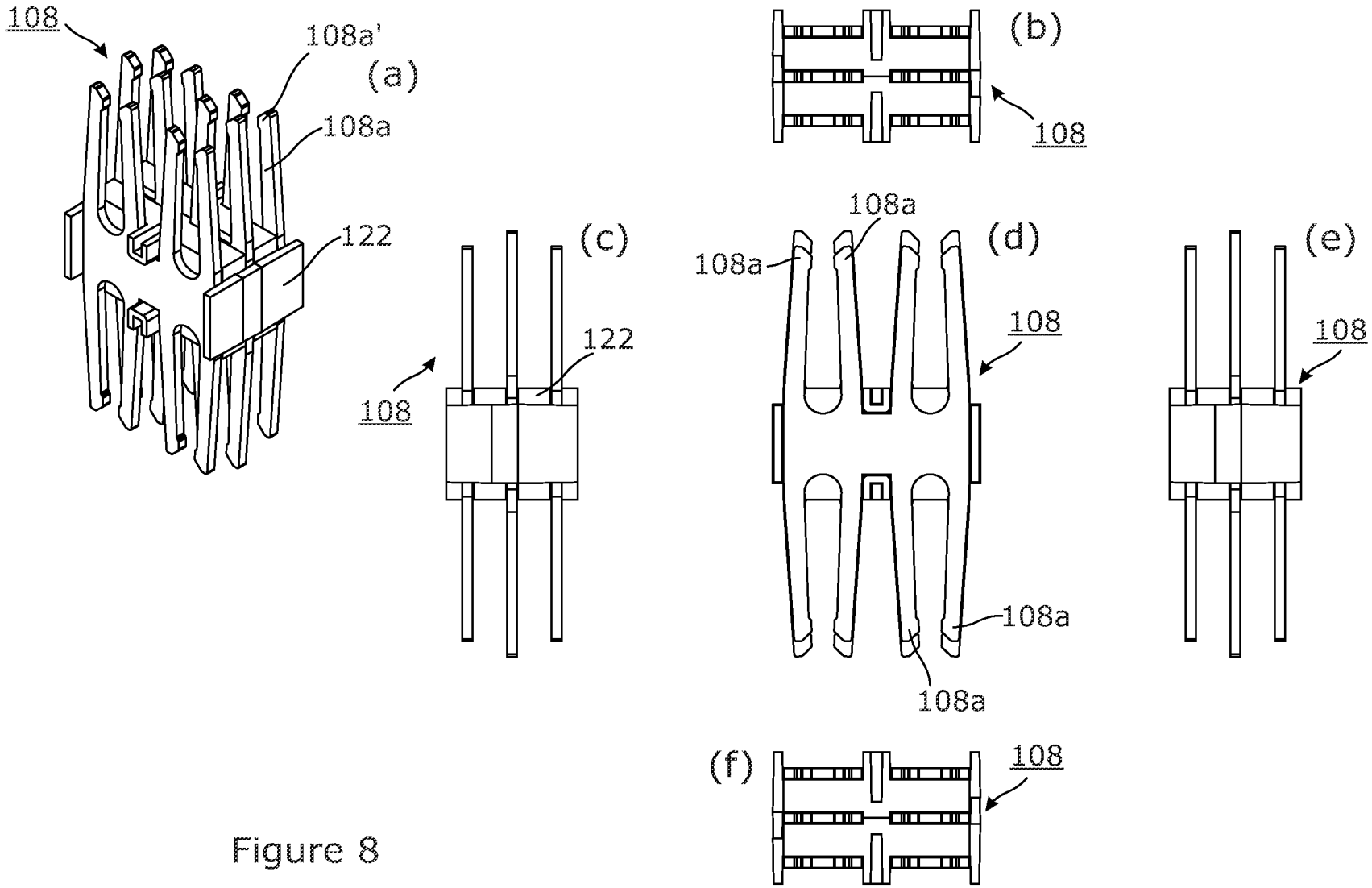
FIGS. 8(*a*)-8(*f*)—show another exemplary embodiment of an array of terminal connections—8(*a*) side perspective view; 8(*b*) top plan view; 8(*c*) side view; 8(*d*) front view; 8(*e*) opposing side view; and 8(*f*) bottom view.

The function of the body portion 104, in addition to retaining the shuttle members 106 in sliding engagement, is to provide a support means for the array of terminal connections 108 (see FIG. 1(*d*) and FIGS. 7 & 8). The array 108 is disposed within the inner central volume of the body portion 104 and comprises a spaced arrangement of conductive contacts. In the example of FIGS. 1(*a*)-(*e*), the spaced arrangement has a substantially 'H'-shaped configuration, with each end portion at the top and bottom of the vertical arms of the H having a shaped contact defining a jaw member 108*a* (see FIGS. 7 & 8). The jaw member 108*a* has a substantially arcuate or flattened 'C'-shaped profile, which is configured and dimensioned to receive a respective resilient clip member 110 of the shuttle member 106 (as discussed below in relation to FIGS. 5A & 5B).

Each H-shaped conductive contact corresponds to a respective one of a Live, Neutral or Earth terminal. In the case of a 3-core mains cable, as shown in FIGS. 1(*a*)-(*e*), the terminal connections are arranged such that there are three H-shaped contacts disposed adjacently and spaced apart from each other by an insulated support (see FIGS. 7(*a*) & 8(*a*)).

Figure 2:
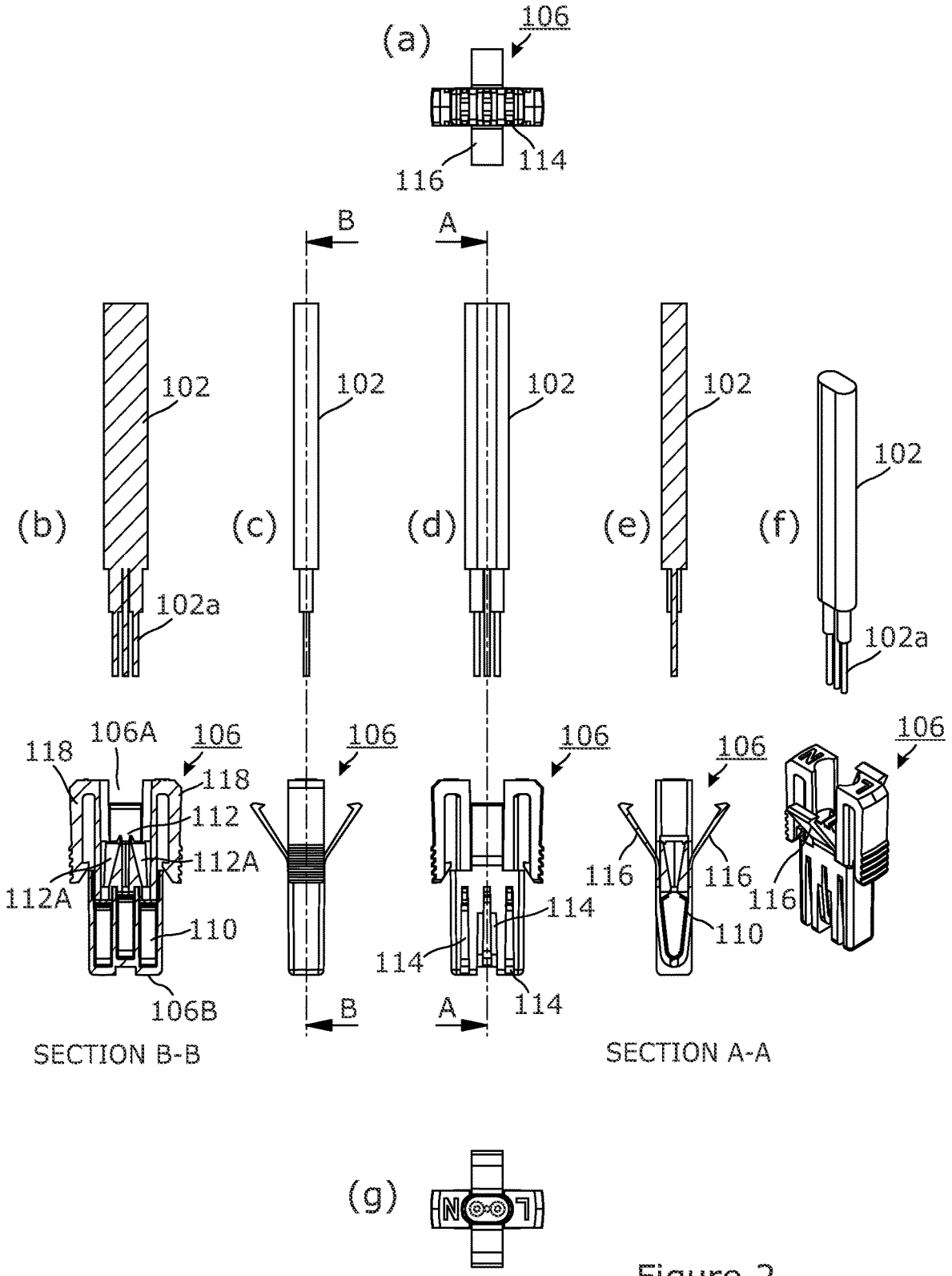
FIGS. 2(*a*)-2(*g*)—show an exemplary embodiment of a shuttle member according to the present invention with the cable not inserted—2(*a*) front view of shuttle member; 2(*b*) cross-section along line B-B of side view of 2(*c*); 2(*d*) top plan view and 2(*e*) cross-section along line A-A; 2(*f*) side perspective view; and 2(*g*) rear end of shuttle member.

Referring to FIGS. 2(*a*)-(*g*) & 3(*a*)-(*g*), there is shown a particularly preferred embodiment of a shuttle member 106 according to the present invention. For clarity of illustration, the shuttle member 106 is shown without the body portion 104. However, it is to be understood that the shuttle member 106 is not intended to be a separate component and is thus always retained within the body portion during use. The shuttle member 106 is configured to receive the previously stripped cable 102, as shown in FIGS. 2(*a*)-(*g*), and then afterwards as inserted in FIGS. 3(*a*)-(*g*). The shuttle member 106 is substantially rectangular in shape and comprises a first end 106*a* to receive the cable 102 and an opposing end 106*b* which is retained within the body portion 104. The shuttle member 106 is operable to slide relative to the body portion.

The first end 106*a* comprises an open channel of circular cross-section (see FIG. 2(*f*)) which is intended to receive and guide the cable 102 towards the core guide means 112 (see FIG. 2(*b*)). The open channel is dimensioned so as be only slightly larger in width than the width dimension of the cable 102 (see FIG. 3(*f*)).

At the opposing end 106*b* of the shuttle member 106 (i.e. the end retained within the body portion 104), there is disposed a plurality of open slots 114 (see FIG. 2(*d*)), with one slot for each of the 3 stripped cores 102*a* to be received. The slots 114 extend parallel to the longitudinal axis of the shuttle member 106 and are disposed adjacent to each other. The resilient clip members 110 are integral to the shuttle member 106 and are arranged such that there is one resilient clip member 110 disposed in each of the slots 114 of the shuttle member 106.

Each resilient clip member 110 takes the form of a conductive metal contact having a substantially flattened 'C'-shaped profile (see FIGS. 2(*e*) & 5A). The 'C'-shaped profile of the resilient clip member 110 defines a compressible jaw, which when compressed together is operable to engage with and grip a core 102*a* of the cable 102. A resilient clip member 110 is disposed in each respective slot 114 such that the open part of the jaw faces inwards towards the centre of the shuttle member 106 (see FIG. 2(*e*)). Therefore, the closed arcuate shaped part of the resilient clip member (which effectively acts as a 'hinge' for the jaw) faces outwards and is accessible through each respective open slot (see FIGS. 2(*d*) & 2(*f*)).

The core guide means 112 is also disposed internally to the shuttle member 106 and is located at the bottom end of the open channel which receives the cable 102 (see FIG. 2(*b*)). The core guide means 112 comprises a baffled channel 112*a* for each of the stripped cores 102*a* of the cable 102, which in the example of FIGS. 2(*a*)-(*g*) means three baffled channels—one each for a Live, Earth and Neutral core of the cable 102. The function of each baffled channel 112*a* is to guide the stripped cores 102*a* towards each of the respective clip members 110, which are so arranged such that their open jaws face towards a respective baffled channel 112*a* (see FIGS. 2(*b*) & 2(*e*)).

As shown in FIG. 2(*b*), the core guide means comprises a 'V' or delta shaped funnel arrangement with three openings leading to a respective baffled channel 112*a*. As the cable 102 is inserted into the opening of the shuttle member 106, the adjacently arranged stripped cores 102*a* then encounter the three openings, which due to the baffle arrangement of the channels 112*a*, results in each of the stripped cores 102*a* being guided into a respective one of the channels 112*a* (see FIG. 3(*b*)). The core guide means 112 is configured such that the stripped cores 102*a* of the cable 102 are splayed apart as the cable 102 is inserted into the shuttle member 106, leading to a separation of the stripped cores 102*a* of at least 3 mm—which is the regulated minimum separation for 240 Vac.

Each opening and baffled channel 112*a* is configured and dimensioned so as to receive only a single stripped core 102*a*. Therefore, there is no possibility of more than one stripped core 102*a* being able to enter into the same channel 112*a* of the core guide means 112. Such a feature therefore advantageously facilitates easy connection of the cable 102 to the connector 100, as the installer need only offer up the stripped cable 102 to the opening of the shuttle member 106 and insert the cable 102, while the core guide means 112 automatically guides the stripped cores 102*a* to their respective channels 112*a* and splays the exposed conductors of the stripped cores 102*a* apart in accordance with the regulated separation.

In practice, the cable is typically stripped back such that about a 20 mm length is inserted into the shuttle member 106, the 20 mm length consisting of about 15 mm of exposed conductor (e.g. wire) and about 5 mm of insulated or sheathed core. The 5 mm of insulation is necessary to maintain creepage and clearance of the exposed conductors, when they are in place in the shuttle member 106 and to avoid any possibility of electrical 'shorting' between the exposed conductors.

Figure 3:
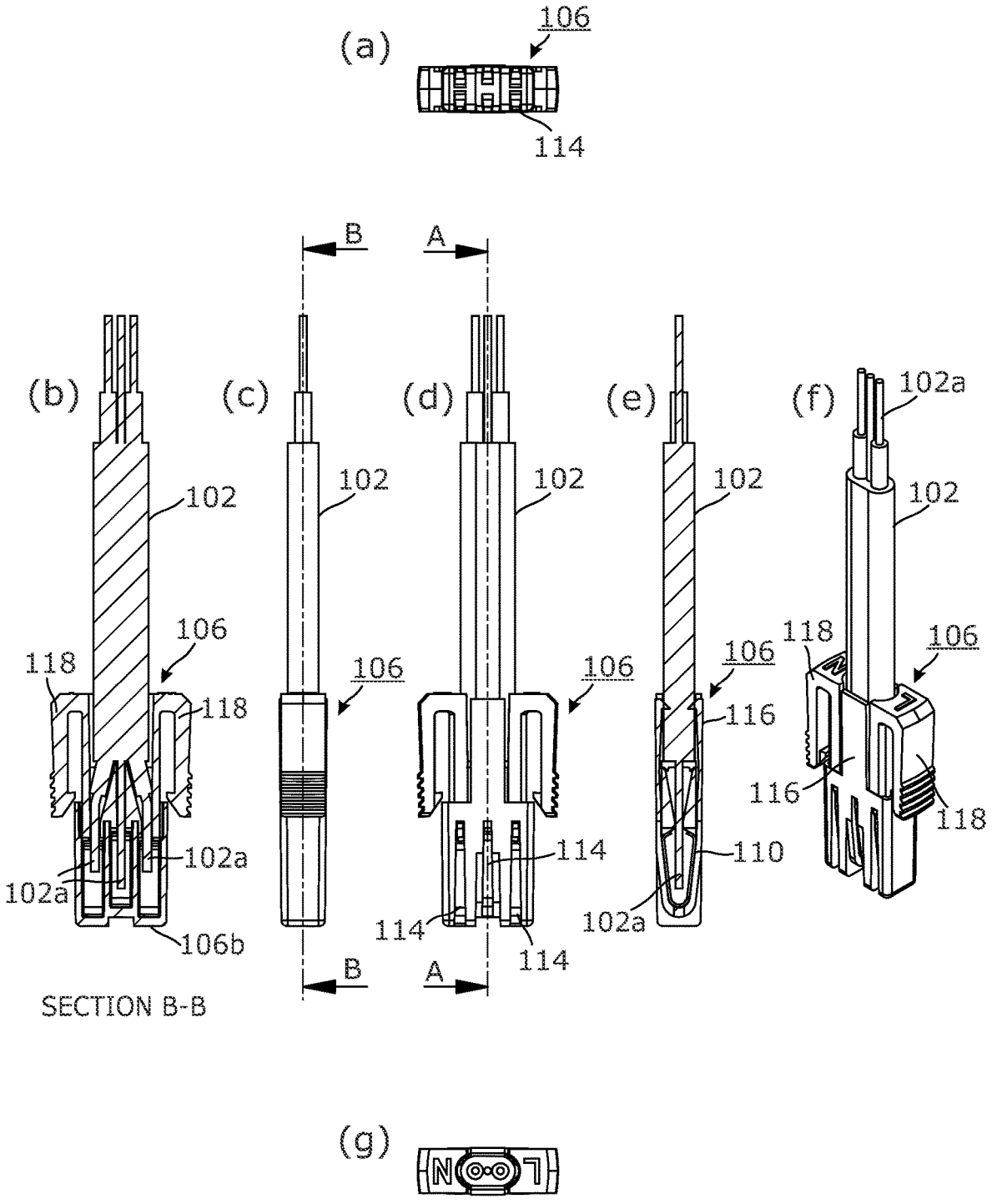
FIGS. 3(*a*)-3(*g*)—show an exemplary embodiment of a shuttle member according to the present invention with the cable inserted—3(*a*) front view of shuttle member; 3(*b*) cross-section along line B-B of side view of 3(*c*); 3(*d*) top plan view and 3(*e*) cross-section along line A-A; 3(*f*) side perspective view; and 3(*g*) rear end of shuttle member.

To assist an installer with the orientation of the cable 102 (to avoid an inadvertent wiring error), the open end 106*a* of the shuttle member 106 is marked with the polarity of the connection (see FIGS. 2(*f*) & 3(*f*)), so that a 'L' for live or a 'N' for neutral is indicated on the body of the shuttle member 106, so that the installer knows which way round the cable 102 needs to be before inserting the cable 102 into the shuttle member 106, as shown in FIGS. 3(*a*)-(*g*).

Once the cable 102 has been inserted into the shuttle member 106, the exposed conductors of the stripped cores 102*a* then reside in each of a respective open jaw of a resilient clip member 110 (see FIGS. 3(*e*) & 5A). However, at this stage, since the clip members 110 are not under compression (since the shuttle member 106 has not yet been advanced into its locked position within the body portion 104), and so the exposed conductors of the stripped cores 102*a* are not yet gripped by the clip members 110.

As shown in FIGS. 2(*c*), 2(*e*) & 2(*f*) & FIGS. 3(*e*) & 3(*f*), the shuttle member 106 further comprises an automatic cable gripping means 116 for gripping the outer surface of the cable 102. The cable gripping means 116 takes the form of a pair of pivotable or hinged arm members attached to the body of the shuttle member 106 with a respective 'hook' at each end. Each arm 116 is disposed on an opposite side of the shuttle member 106, such that the hook can automatically engage with the outer sheath of the unstripped portion of the cable 102 when the shuttle member 106 is slidingly advanced further into the body portion 104 so that it is fully engaged. The arms 116 are then pressed against the cable 102, thereby firmly gripping the cable 102. Thereafter, cable 102 could only be removed with considerable force.

The shuttle member 106 also comprises a pair of protrudences or elongate arms 118 integral to the body of the shuttle member 106 and which serve as latches for latching the shuttle member 106 to the body portion 104, enabling the body portion 104 to retain the shuttle member 106, and also for gripping the shuttle member during manipulation, e.g. when inserting the cable 102 etc. The protrudences 118 extend along the longitudinal axis of the cable shuttle member 106 and are texturised to facilitate grip of the shuttle member 106 during sliding advancement into the body portion 104.

Figure 4:
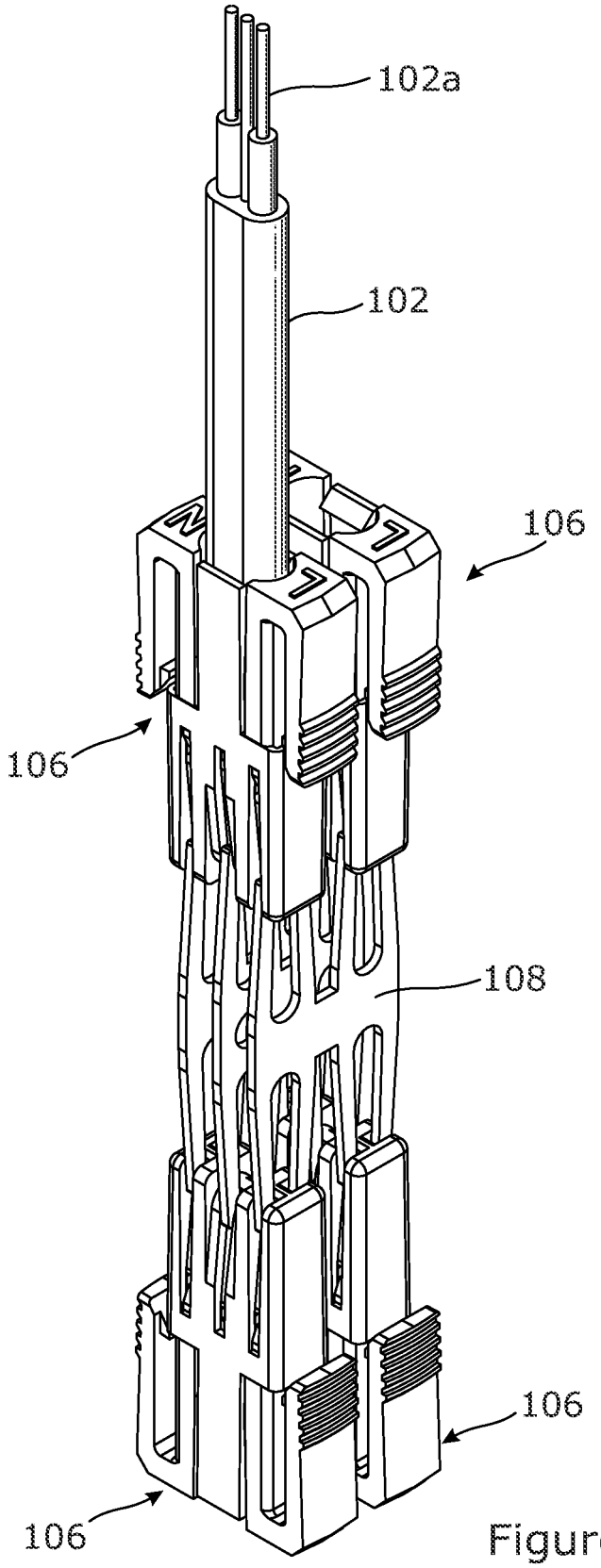
FIG. 4—shows a partial cut-away of the electrical connector of FIG. 1(*e*) with the shuttle member not fully engaged.
Figure 5A:
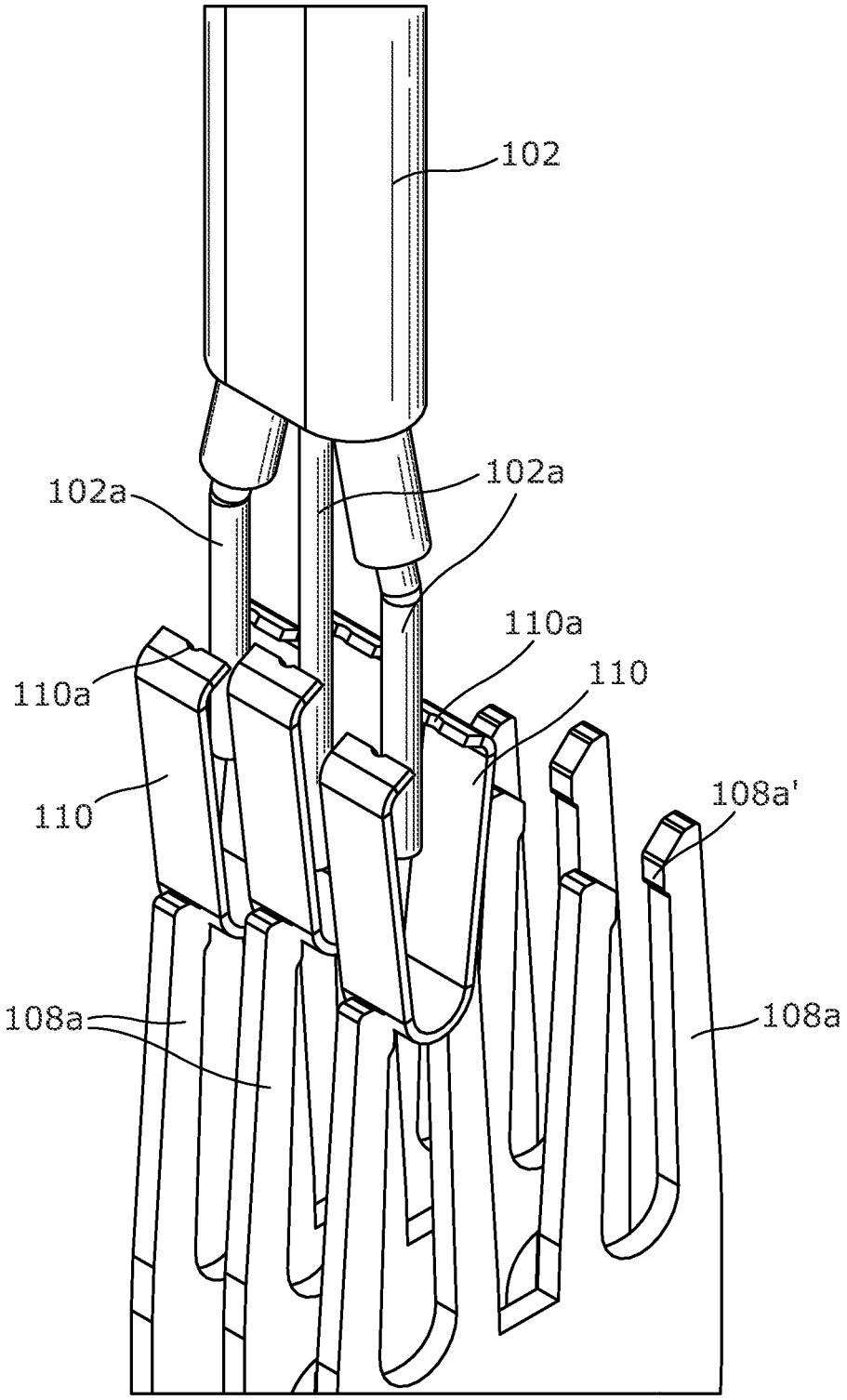
FIG. 5A—shows a close-up view and partial cut-away of an exemplary embodiment of the resilient clip members with the shuttle member not fully engaged.

The array of terminal connections 108 is arranged within the body portion 104 such that when the shuttle member 106 is advanced further into the body portion 104 by pushing on the cable 102, the resilient clip members 110 of the shuttle member 106 engage with a respective one of the jaw members 108*a* of the shaped contacts (see FIGS. 4 & 5A—in these figures the body portion 104 has not been drawn for clarity reasons). As the resilient clip members 110 are forced into the jaw members 108*a* of the shaped contacts, the clip members 110 are then compressed and deflected by the jaw members 108*a*, causing the open jaws of the clip members 110 to close around a respective exposed conductor of a stripped core 102*a* of the cable 102, as shown in FIG. 5B.

It is important, however, to ensure that shuttle member 106 does not advance into the body portion 104 before the cable 102 is fully inserted into the shuttle member 106, since otherwise, if the exposed conductors of the stripped cores 102*a* are not in their correct positions, the open jaws of the resilient clip members 110 will begin to close without gripping the exposed conductors 102*a*. However, motion of the shuttle member 106 is at least initially resisted by the resilience of the clip members 110 themselves (i.e. resisting insertion into the jaw members 108*a*) and by the latching mechanism between the shuttle member 106 and the body portion 104. So only when an installer provides sufficient force, is the shuttle member 106 then able to advance into the body portion 104 towards its fully engaged or locked position, by which time the cable 102 and the exposed conductors of the stripped cores 102*a* should all be in their correct positions. This action can all be achieved by the installer pushing on the cable 102 with one hand and holding the body portion 104 with his other hand.

Figure 5B:
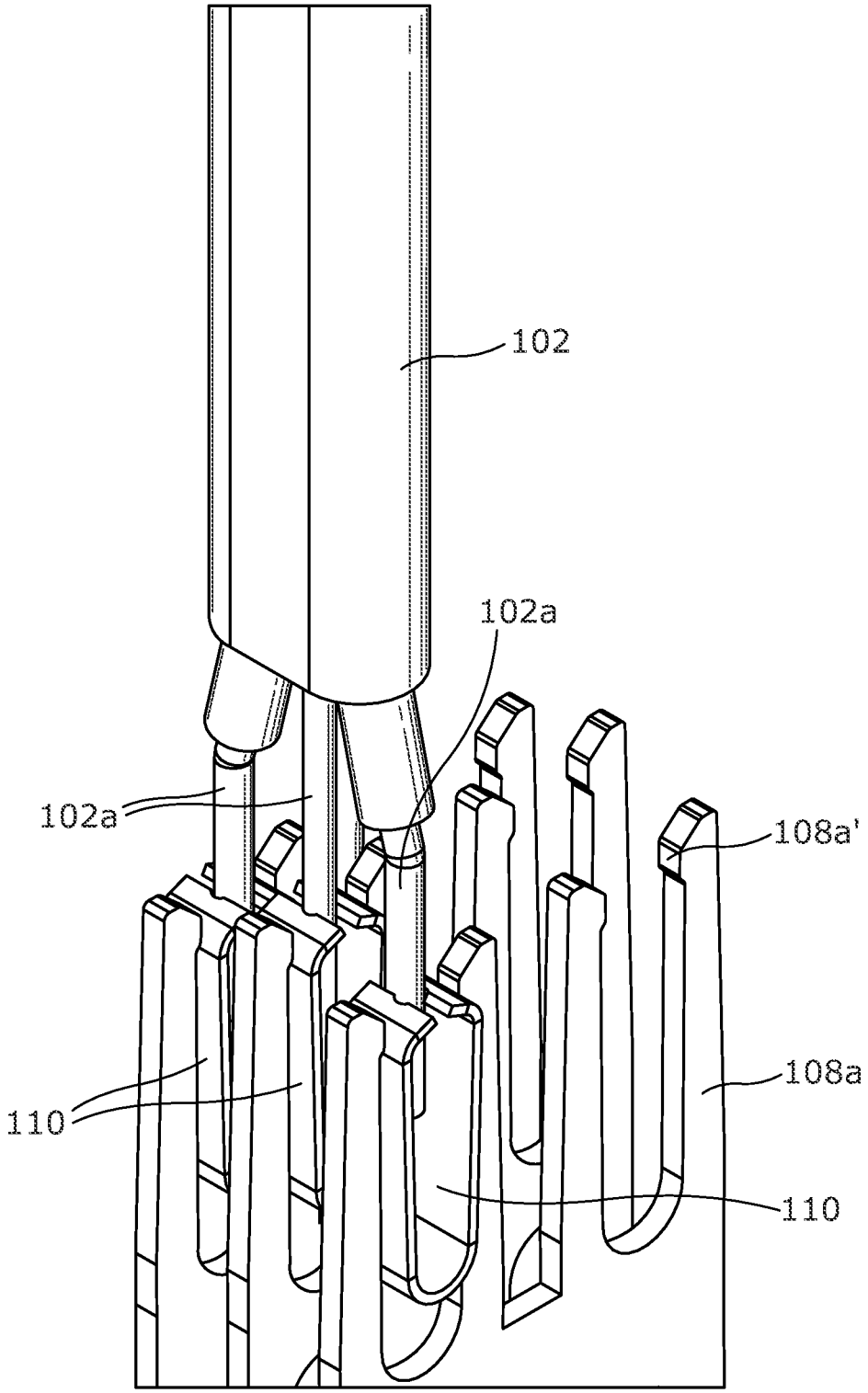
FIG. 5B—shows a close-up view and partial cut-away of an exemplary embodiment of the resilient clip members with the shuttle member fully engaged.
Figure 6:
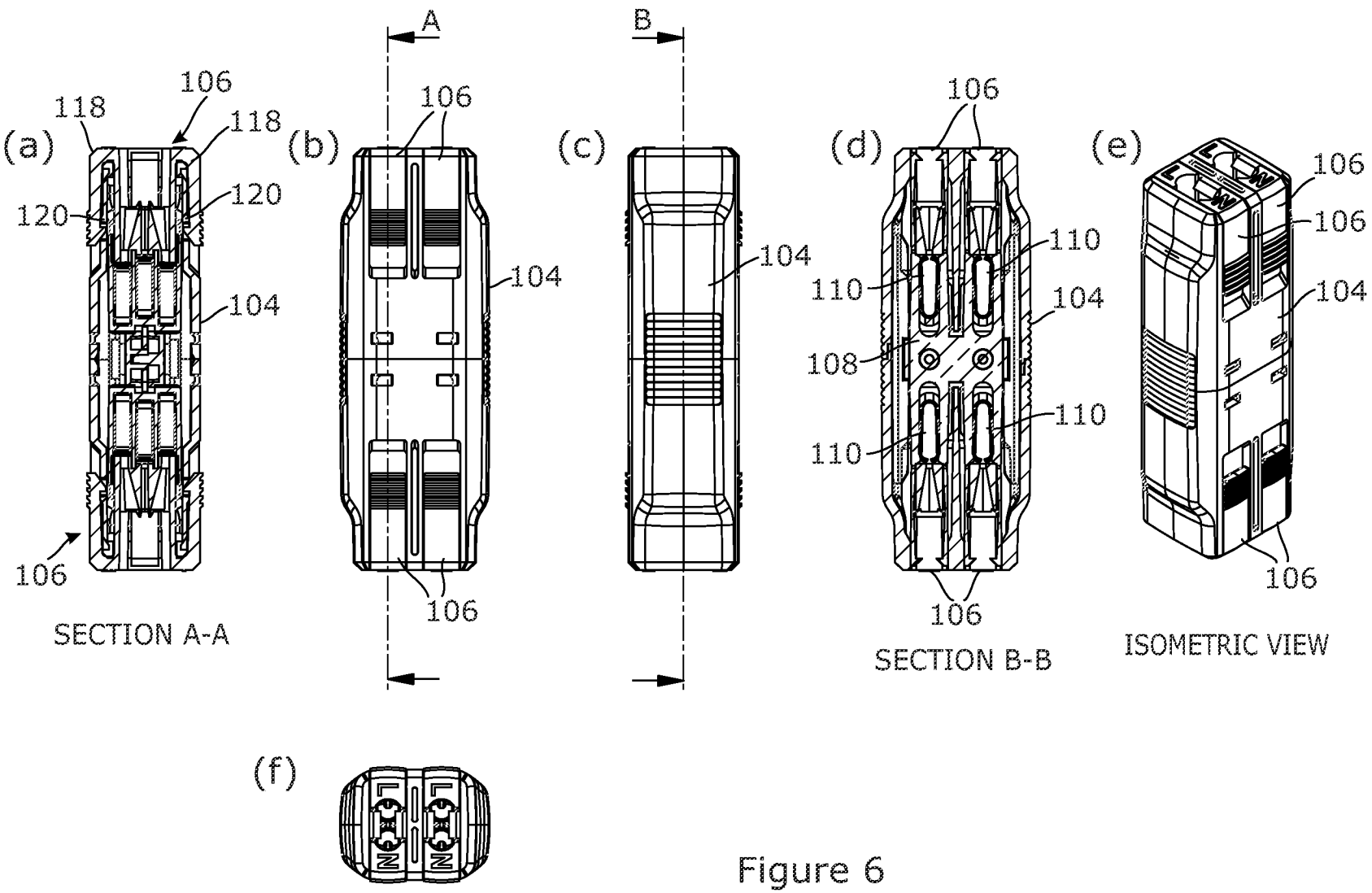
FIGS. 6(*a*)-6(*f*)—show the electrical connector of FIGS. 1(*a*)-1(*e*) with the shuttle member fully engaged—6(*a*) cross-section along line A-A of side view of 6(*b*); 6(*c*) top plan view and 6(*d*) cross-section along line B-B; 6(*e*) side perspective view; and 6(*f*) top end view.

When the shuttle member 106 is locked in position (as shown in FIGS. 6(*a*)-(*f*)—the cable 102 not being shown for clarity reasons), the resilient clip members 110 then reside within the jaw members 108*a* of the shaped contacts and a firm grip of the exposed conductors of the stripped cores 102*a* is then achieved by each respective clip member 110 (see FIG. 5B). The cable 102 is then consequently secured and a safe and reliable electrical connection is made between each respective exposed conductor, clip member 110 and shaped contact of the body portion 104—without any risk that the exposed conductors can become lose or otherwise pop out of the shaped contacts.

To facilitate engagement with the exposed conductors of the stripped cores 102*a* of the cable 102, each resilient clip member 110 includes a recessed notch 110*a* at the edge of each jaw member to receive and grip the exposed conductors of the cable 102 as the clip member 110 is compressed. The recessed notch 110*a* is semi-circular in form (see FIG. 5A).

As shown in FIG. 5A, the leading edges of the jaw members 108*a* of the shaped contacts also comprise a lipped portion 108*a*' to narrow the opening of the jaw member 108*a* to thereby enhance compression of the resilient clip member 110 (see FIG. 5B).

As described, the body portion 104 is operable to lock the shuttle member 106 into the body portion 104 when the shuttle member 104 is fully engaged. The protrudences 118 on the shuttle member 106 latch against reciprocal detents 120 in the interior of the body portion 104 (see FIG. 6(*a*)), resulting in a non-reversible connection between the shuttle member 104 and the body portion 106. By 'non-reversible' we mean that the shuttle member 106 cannot now be withdrawn from its locked position without excessive force, resulting in damage to either the shuttle member or body portion, or both the shuttle member and body portion.

Referring to FIGS. 7(*a*)-(*f*) & 8(*a*)-(*f*), there is shown example arrangements of the terminal connections for use with the electrical connector of the present invention. As described above, these terminal connections are disposed within the body portion 104 and serve to provide both electrical connectivity between the cables and to compress the resilient clip members 110 of the shuttle member 106 by way of the jaw members 108*a*.

As shown in FIGS. 7(*a*)-(*f*) & 8(*a*)-(*f*), the terminal connections have a substantially 'H'-shaped configuration, with each end portion at the top and bottom of the vertical arms of the H having a shaped contact defining the jaw member 108*a*. In the example shown, each H-shaped contact corresponds to a respective one of a Live, Earth or Neutral terminal disposed adjacently and spaced apart from each other by an insulated support 122.

The H-shaped contacts in FIGS. 7(*a*)-(*f*) are configured such that a discontinuity or insulated break is formed in one or more of the H-shaped contacts which are then electrically connected to one or more other of the contacts (see FIG. 7(*e*)), so that the electrical connector can be used as a switch and light junction unit (as shown in FIGS. 9, 10A &

10B—denoted as a 'Type 1' electrical connector). By contrast, in FIGS. 8(*a*)-(*f*), the H-shaped contacts are configured so that each contact is continuous and conductive throughout the contact, and is isolated from the others, so that the electrical connector can be used as a spur or light junction unit (as shown in FIGS. 9, 10A & 10B—denoted as a 'Type 2' electrical connector).

FIGS. 9, 10A & 10B show example circuit layouts for possible lighting circuits constructed using the electrical connector of the present invention. It should be understood that these circuits are in no way limiting and thus represent merely illustrative examples of how a lighting circuit may be wired up.

In FIG. 9, there is shown a 'Type 1' electrical connector 100 in which the junction box acts as a switch and light junction unit $\mathbf{100}_1$, such that it can receive power from a power source (POWER IN) on cable $\mathbf{102}_1$ and provide an output power (POWER OUT) on cable $\mathbf{102}_2$. A switch 124 on cable $\mathbf{102}_3$ controls the availability of power to a light 126 connected to the unit $\mathbf{100}_1$ via cable $\mathbf{102}_4$. Alternatively, one or more additional lights 128 could be connected to the unit $\mathbf{100}_1$ via an electrical connector 100 acting as a spur/light junction unit $\mathbf{100}_2$ to thereby extend the lighting circuit.

An extended lighting circuit is shown in FIG. 10A, in which a spur/light junction unit $\mathbf{100}_2$ has been connected to a switch and light junction unit $\mathbf{100}_1$. An additional power line has been taken from the unit $\mathbf{100}_1$ and acts as the input power for an additional switch and light junction unit $\mathbf{100}_1$'. A further switch 124' serves to control the power to an additional spur/light junction unit $\mathbf{100}_2$', to which are attached more lights 128'.

In an alternative circuit as shown in FIG. 10B, the lighting can also be extended by taking an additional power line from the spur/light junction unit $\mathbf{100}_2$, which can then act as the input power for an additional switch and light junction unit $\mathbf{100}_1$'. A further switch 124' serves to control the power through the unit $\mathbf{100}_1$', to which are attached more lights 128'.

Therefore, as can be appreciated from FIGS. 9, 10A & 10B, there are numerous possibilities and permutations for wiring a lighting circuit using the electrical connector of the present invention. Indeed, it is evident that the circuit is inherently scalable and can be extended whenever a change of lighting is required and/or when a domestic residence or commercial property is altered or changed for some reason.

Although the electrical connector of the present invention is ideally suited as a low-profile electrical junction box for lighting circuits, it will be recognised that one or more of the principles of the invention may extend to other connector and/or circuit types, whereby it is required to quickly and reliably connect one or more multi-core cables together to ensure a safe and maintenance-free electrical connection.

Thus, the above embodiments are described by way of example only. Many variations are possible without departing from the invention.

We claim:

1. An electrical connector, comprising:

a shuttle member for receiving a stripped multi-core cable, the shuttle member including a core guide and a resilient clip member for each of the stripped cores to be received; and a body portion configured to support at least one shuttle member in sliding engagement and including an array of terminal connections, each terminal connection having a shaped contact to receive a respective resilient clip member of the shuttle member;

wherein each shaped contact defines a jaw member that is operable to compress a respective resilient clip member when the shuttle member is advanced into the body portion to thereby grip the stripped cores of the multi-core cable in said respective resilient clip members when the shuttle member is fully engaged with the body portion.

2. The electrical connector of claim 1, wherein the shuttle member has a first end for receiving the multi-core cable and an opposing end adapted to be retained within the body portion.

3. The electrical connector of claim 1, wherein the resilient clip members are integral to the shuttle member.

4. The electrical connector of claim 1, wherein each resilient clip member defines a compressible jaw operable to engage with and grip a stripped core.

5. The electrical connector of claim 1, wherein each resilient clip member is conductive.

6. The electrical connector of claim 1, wherein each resilient clip member has a substantially flattened 'C'-shaped profile.

7. The electrical connector of claim 1, wherein the resilient clip members are disposed adjacent to each other.

8. The electrical connector of claim 1, wherein the shuttle member comprises three resilient clip members.

9. The electrical connector of claim 1, wherein the body portion is substantially elongate.

10. The electrical connector of claim 1, wherein the body portion is configured to support and retain at least two shuttle members.

11. The electrical connector of claim 1, wherein the body portion is operable to lock the shuttle member when the shuttle member is fully engaged with the body portion.

12. The electrical connector of claim 1, wherein the array of terminal connections comprises a spaced arrangement of conductive contacts.

13. The electrical connector of claim 12, wherein the spaced arrangement has a substantially H-shaped configuration.

14. The electrical connector of claim 13, wherein each H-shaped conductive contact corresponds to a respective one of a live, neutral or earth terminal.

15. The electrical connector of claim 1, wherein the core guide is disposed internally to the shuttle member.

16. The electrical connector of claim 1, wherein the core guide comprises a baffled channel for each of the stripped cores to be received, each baffled channel being operable to guide the stripped cores into a respective clip member.

17. The electrical connector of claim 16, wherein each baffled channel is configured and dimensioned so as to receive only a single stripped core.

18. The electrical connector of claim 1, wherein the shuttle member further comprises a gripping for gripping the outer surface of the multi-core cable when the shuttle member is fully engaged with the body member.

19. An electrical circuit, comprising:

a power source; and at least one electrical connector according to claim 1.

20. The electrical circuit of claim 19, further comprising at least one light source connected to the power source and at least one of the electrical connectors.

* * * * *